US008807684B2

(12) United States Patent
Allworth et al.

(10) Patent No.: US 8,807,684 B2
(45) Date of Patent: Aug. 19, 2014

(54) METHOD OF IDENTIFYING DEFECTIVE NOZZLES IN AN INKJET PRINTHEAD

(71) Applicant: Zamtec Limited, Dublin (IE)

(72) Inventors: Peter Allworth, North Ryde (AU); Matthew Baker, North Ryde (AU)

(73) Assignee: Memjet Technology Ltd., Dublin (IE)

( * ) Notice: Subject to any disclaimer, the term of this patent is extended or adjusted under 35 U.S.C. 154(b) by 0 days.

(21) Appl. No.: 14/020,128

(22) Filed: Sep. 6, 2013

(65) Prior Publication Data

US 2014/0085369 A1 Mar. 27, 2014

Related U.S. Application Data

(60) Provisional application No. 61/704,094, filed on Sep. 21, 2012.

(51) Int. Cl.
*B41J 2/165* (2006.01)

(52) U.S. Cl.
USPC ..... 347/14; 347/19; 347/107

(58) Field of Classification Search
CPC .... B41J 29/393; B41J 2/0451; B41J 2/16579; B41J 2/165
USPC ..... 347/14, 19, 105–17
See application file for complete search history.

(56) References Cited

U.S. PATENT DOCUMENTS

2007/0176965 A1 8/2007 Arazaki
2011/0227988 A1* 9/2011 Yamazaki ..... 347/19

FOREIGN PATENT DOCUMENTS

EP 1147900 A1 10/2001
EP 2042324 A2 4/2009
JP 2007-290404 A 11/2007

OTHER PUBLICATIONS

International Search Report and Written Opinion for PCT/EP2013/068859 issued Nov. 22, 2013, 10 pages.

* cited by examiner

*Primary Examiner* — Thinh Nguyen
(74) *Attorney, Agent, or Firm* — Cooley LLP

(57) ABSTRACT

A method of identifying defective nozzles of a printhead. The method includes the steps of: (i) instructing each nozzle in one ink plane of the printhead to print a respective coded line pattern, each coded line pattern being represented by a column of printed pixels and absent pixels, the coded line patterns being defined by first and second coding schemes encoding a position of each nozzle within its respective cell and a position of each cell within its respective ink plane; (ii) firing each nozzle of the ink plane to print a test pattern comprising a plurality of neighboring coded line patterns; (iii) imaging an area of the test pattern to obtain an imaged test pattern; (iv) decoding the imaged test pattern using the first and second coding schemes; and (iv) identifying the defective nozzles using the decoded imaged test pattern.

20 Claims, 9 Drawing Sheets

METHOD OF IDENTIFYING DEFECTIVE NOZZLES IN AN INKJET PRINTHEAD

FIELD OF THE INVENTION

The present invention relates generally to inkjet printers and in particular to identifying defective nozzles in a printhead of an inkjet printer.

BACKGROUND

A need exists to gather information regarding the functionality of printheads in terms of nozzle integrity, including the detection of non-functional or dead nozzles. Such information is critical during production phases for initial printhead calibration and also, more importantly, during key technology developmental stages and recalibration phases. In certain high-end commercial printers, it may also be desirable to provide information on dead nozzles during use without resorting to very high resolution scanning technology. Providing fast, robust, scalable yet affordable approaches to ascertain the aforementioned nozzle integrity information are essential to successful inkjet technological advancement.

Dead nozzles are typically detected by printing a specially designed pattern onto a sample of print media. The printed media is then digitized using an electronic imaging device, such as a charge-coupled device (CCD) line scanner, to form an image of the printed pattern. Finally the image of the pattern is analysed to extract the appropriate information. However, prior art methods are generally limited in terms of speed, cost, scalability and/or reliability.

FIG. 1 shows an image of an example pattern used for detecting dead nozzles. Arrow 100 indicates the direction of printing. The example pattern is formed by dividing the nozzles of the printhead in groups, and then controlling a single nozzle from each group to print a line segment having a predetermined length, such as line segment 101. After the single nozzle from each group has completed its line segment, a next neighbouring nozzle from each of the groups is controlled to each print another line segment, and so on, until all the nozzles of the printhead have printed a respective line segment. In the example pattern shown in FIG. 1 a space, such as space 102, is left between line segments printed by successive neighbouring nozzles to assist in discriminating between the line segments printed by respective nozzles. Furthermore, due to the fact that only one nozzle in each group prints at any one time, the line segments are separated in a direction transverse to the direction of movement, such as separation 103. The separation 103 is determined, to a large extent, by the resolving characteristics of the imaging device used to analyse the test pattern.

As is evident from the example pattern shown in FIG. 1, the pattern is spatially sparse and includes a large amount of blank space. Since the blank space contains no information, the example pattern, and other similar patterns, may be considered inefficient and require imaging of a large area of the page to gather the requisite dead nozzle information.

Perhaps a more significant deficiency of the example pattern shown in FIG. 1 is that the printhead is driven in an unconventional and unrealistic state; while a particular nozzle prints its line segment, none of its neighbouring nozzles are printing. Some print artifacts (e.g. those arising from poor nozzle chamber refill rates) are only apparent when groups of neighbouring nozzles are printing simultaneously. Hence, the example pattern shown in FIG. 1 may fail to detect some malfunctioning nozzles in a realistic printing scenario.

Still referring to FIG. 1, the existence of a dead nozzle is indicated by the absence of a line segment 101, such as in area 104. Current approaches share a similar methodology for establishing the presence of a line segment by quantifying the amount of deposited ink on the media at a sampled position within the pattern. However, those methods are vulnerable to interferences e.g. droplet misdirections or "keep-wet-spitting" 105 where nozzles are intermittently driven to eject ink and prevent nozzle dehydration (see, for example, U.S. Pat. No. 7,246,876, the contents of which are herein incorporated by reference).

A difficulty experienced after identifying an area 104 where the line segment is absent, is to determine which nozzle in the printhead is defective. To assist in identifying the defective nozzle, a number of registration marks/fiducials are printed alongside the pattern. FIG. 2 shows an example pattern 201 including registration marks/fiducials 202 and 203. Processing of the registration marks/fiducials 202 and 203, and using the registration marks/fiducials 202 and 203 to identify defective nozzles add significantly to the overall processing, and also further add to the inefficiencies already existing in the pattern.

It would be desirable to provide a method of identifying defective nozzles in a printhead, which is fast, reliable, and scalable to printheads having large numbers of nozzles, such as pagewidth printheads.

It would further be desirable to provide a method of identifying defective nozzles in a realistic printing state of the printhead, where neighbouring nozzles are fired simultaneously. In the present context, "fired simultaneously" is taken to mean "fired within one line-time", one line-time being the time allocated to a row of nozzles to print one line of an image.

SUMMARY OF INVENTION

In a first aspect, there is provided a method of identifying defective nozzles of a printhead having one or more ink planes, each ink plane comprising at least one row of nozzles supplied with a same ink, the nozzles in one ink plane being nominally divided into a plurality of neighbouring cells, each cell comprising a set of neighbouring nozzles, said method comprising the steps of:

instructing each nozzle in one ink plane of the printhead to print a respective coded line pattern, each coded line pattern being represented by a column of printed pixels and absent pixels, the coded line patterns being defined by first and second coding schemes, the first coding scheme encoding a position of each nozzle within its respective cell and the second coding scheme encoding a position of each cell within its respective ink plane, firing each nozzle of the ink plane to print a test pattern comprising a plurality of neighbouring coded line patterns having zero offset in a media feed direction;

imaging an area of the test pattern to obtain an imaged test pattern;

decoding the imaged test pattern using the first and second coding schemes; and identifying the defective nozzles using the decoded imaged test pattern.

The method according to the first aspect advantageously enables detection of dead nozzles when neighbouring nozzles from one ink plane are fired simultaneously. In particular, the use of two different coding schemes, as described, enables identification of dead nozzles, even when neighbouring nozzles of the printhead are fired simultaneously. An additional advantage of the two different coding schemes is that dead nozzles are detectable even at relatively low imaging resolutions. Therefore, the method may be used in connection with printheads installed in the field, as well as during printhead qualification and testing. These and other advantages will be readily apparent from the detailed description of the invention below.

Preferably, the test pattern comprises a two-dimensional array of contiguous bi-level pixels i.e. an array of contiguous printed pixels and absent pixels, the printed pixels all being printed with the same ink.

Preferably, the first coding scheme is a binary code employing first bit values of 1 and 0. A first bit value of 1 is typically represented by printed pixels in first cells and absent pixels in second (inverse) cells; and a first bit value of 0 is typically represented by absent pixels in the first cells and printed pixels in the second (inverse) cells. Thus, the first and second cells represent same bit values of the first coding scheme differently.

Preferably, second bit values in the second coding scheme are represented by the first cells and the inverse second cells. Hence, the first and second coding schemes are both used to define the coded line patterns of each cell.

Preferably, a cell of nozzles is defined as k neighbouring nozzles, wherein k is an integer from 2 to 100, said cell of nozzles printing a corresponding cell of k neighbouring coded line patterns.

Preferably, each ink plane comprises at least 1000, at least 3000, at least 5000 or at least 10,000 nozzles.

Preferably, a separation between centroids of printed pixels in one row of the test pattern is less than 50 microns, less than 40 microns or less than 30 microns.

Preferably, the nozzles in one cell are physically juxtaposed and/or logically juxtaposed. Physically juxtaposed nozzles are typically nozzles which are physically neighbouring each other within one nozzle row of the printhead. Logically juxtaposed nozzles are typically from different nozzle rows within the same ink plane, but print neighbouring dots onto a same printed line. For example, one ink plane may comprise a pair of nozzle rows for printing 'even' and 'odd' dots onto a page. A nozzle from the 'even' row may be logically juxtaposed with two nozzles from the 'odd' row, even though the 'even' nozzle is not physically juxtaposed with the 'odd' nozzles on the printhead. Likewise, the two nozzles from the 'odd' row may be physically juxtaposed, but not logically juxtaposed.

Preferably, the coded line patterns printed by respective nozzles contained within any one cell define mutually orthogonal codes at zero offset. In the present context, "zero offset" generally means that the coded line patterns are not offset from each other in the media feed direction; in other words, the first pixel position of each coded line pattern is in the same row of print.

Preferably, the first coding scheme is based on a Hadamard matrix (e.g. a Walsh code). Preferably, a first column (i.e. column 0) of the Hadamard matrix is discarded in the first coding scheme. Preferably, and having discarded the first column, only every second column of the Hadamard matrix is employed in the first coding scheme i.e. columns 2, 4, 6 etc.

Preferably, the second coding scheme is based on an M-sequence.

Each ink plane may have a respective second coding scheme (e.g. a different M-sequence for each ink plane). Alternatively, one second coding scheme may be used to encode cell positions across all ink planes of the printheads (e.g. one M-sequence for all ink planes). In either scenario, it will be appreciated that the second coding scheme encodes the position of each cell within its respective ink plane.

Preferably, the M-sequence is of length $(2^n-1)$, wherein n is an integer of 1 or more, and the imaged area of the test pattern contains complete coded line patterns for at least n complete cells.

Preferably, each line pattern is balanced—that is, having an equal number of printed pixels and absent pixels.

Preferably, the line patterns are based on codewords, and the imaged test pattern is decoded by calculating the inner product ("dot product") between the respective codewords and respective line patterns.

Preferably, defective nozzles are identified by determining whether the decoded imaged test pattern contains invalid values.

In a second aspect, there is provided a print medium having a test pattern printed thereon from at least one ink plane of a printhead, each ink plane comprising at least one row of nozzles supplied with a same ink, the nozzles in one ink plane being nominally divided into a plurality of neighbouring cells, each cell comprising a set of neighbouring nozzles, wherein the test pattern comprises a plurality of neighbouring coded line patterns printed from respective neighbouring nozzles of the ink plane, each coded line pattern being represented by a column of printed pixels and absent pixels, the coded line patterns being defined by first and second coding schemes, the first coding scheme encoding a position of each nozzle within its respective cell and the second coding scheme encoding a position of each cell within its respective ink plane.

In a third aspect, there is provided an apparatus for identifying defective nozzles of a printhead having one or more ink planes, each ink plane comprising at least one row of nozzles supplied with a same ink, the nozzles in one ink plane being nominally divided into a plurality of neighbouring cells, each cell comprising a set of neighbouring nozzles, said apparatus comprising:

a sensor for optically imaging an area of a test pattern printed on a print medium, the test pattern comprising a plurality of neighbouring coded line patterns printed from respective neighbouring nozzles of an ink plane of the printhead, each coded line pattern being represented by a column of printed pixels and absent pixels, the coded line patterns being defined by first and second coding schemes, the first coding scheme encoding a position of each nozzle within its respective cell and the second coding scheme encoding a position of each cell within its respective ink plane; and a processor configured for:

decoding the imaged test pattern using the first and second coding schemes; and identifying the defective nozzles using the decoded imaged test pattern.

Preferably, the first coding scheme is based on a Hadamard matrix and the second coding scheme is based on an M-sequence.

Preferably, the M-sequence is of length $(2^n-1)$, wherein n is an integer of 1 or more, and the imaging area (i.e. field of view) of the optically imaging sensor is dimensioned to capture at least n complete cells. Typically, the field of view of the optically imaging sensor is less than the entire extent of the test pattern.

In some embodiments, the apparatus may be in the form of a printer comprising an inkjet printhead, an optically imaging device and a processor. A printer comprising an integrated scanner positioned in a media feed path downstream of a printhead is described in, for example, US 2011/0025799. Of course, other types of multifunction printers with integrated scanners are well known in the art.

BRIEF DESCRIPTION OF THE DRAWINGS

Some aspects of the prior art and one or more embodiments of the present invention will now be described with reference to the drawings, in which.

DETAILED DESCRIPTION

Figure 1:
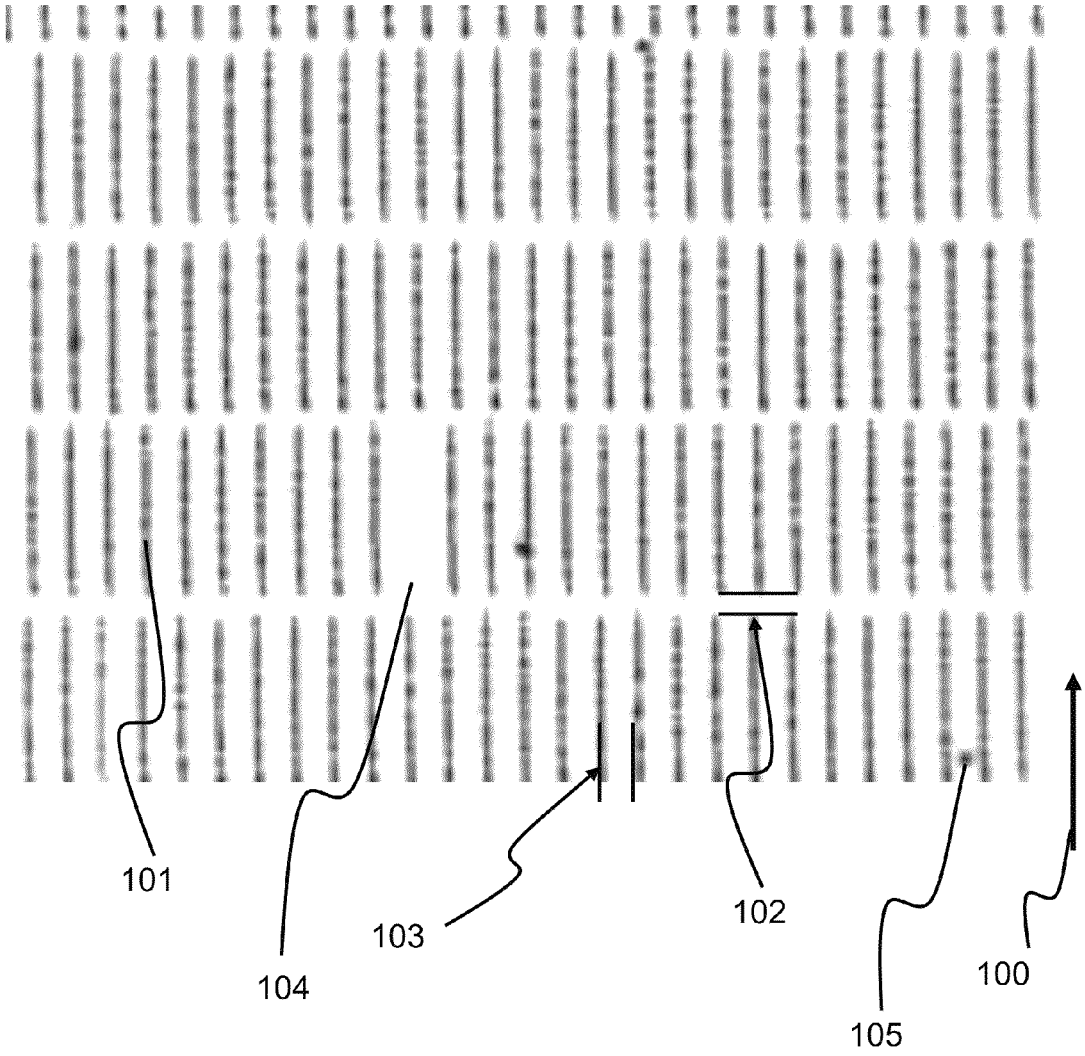
Fig. 1 (Prior Art)
FIG. 1 shows an image of an example pattern used for detecting dead nozzles.
Figure 2:
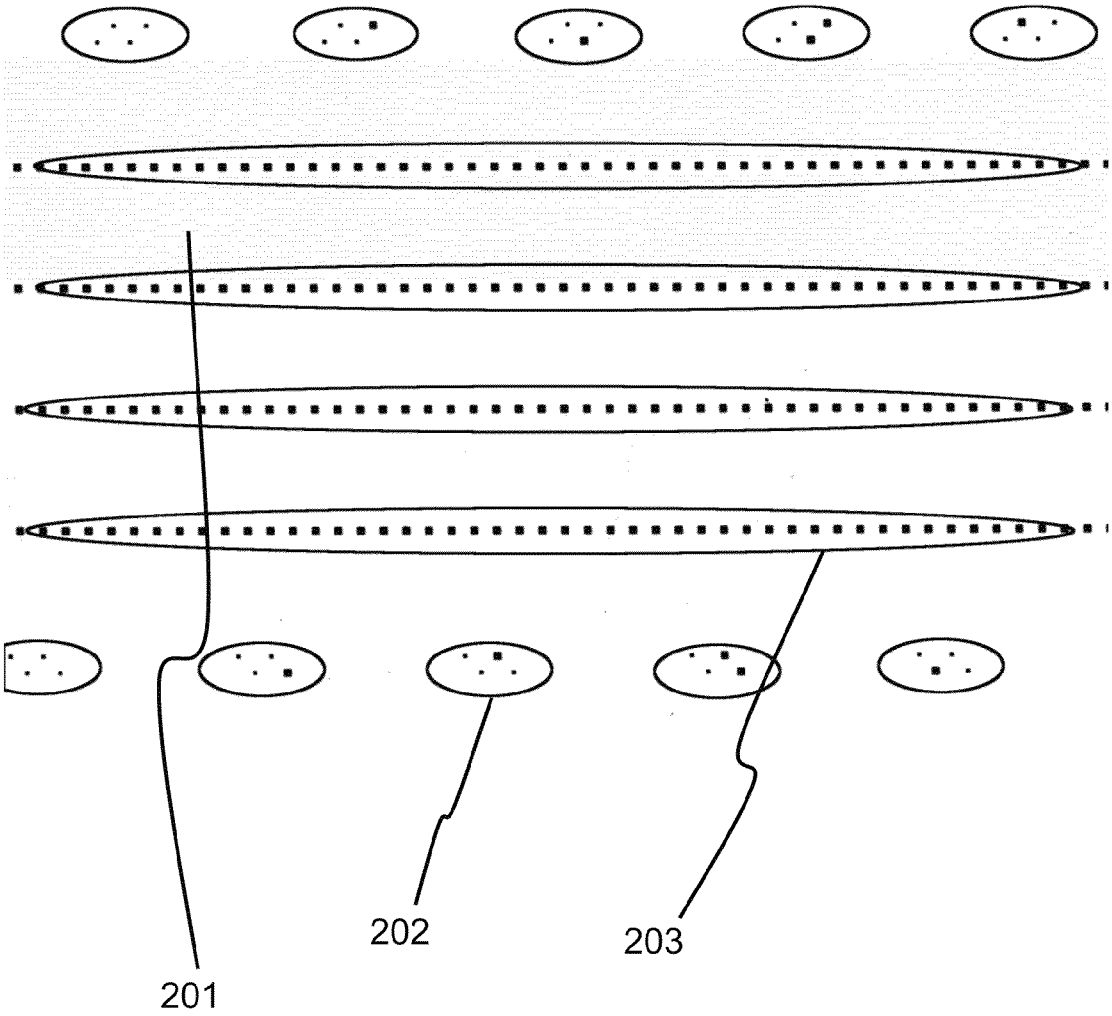
Fig. 2 (Prior Art)
FIG. 2 shows an example pattern including registration marks/fiducials.

Where reference is made in any one or more of the accompanying drawings to steps and/or features, which have the same reference numerals, those steps and/or features have for the purposes of this description the same function(s) or operation(s), unless the contrary intention appears.

Figure 3:
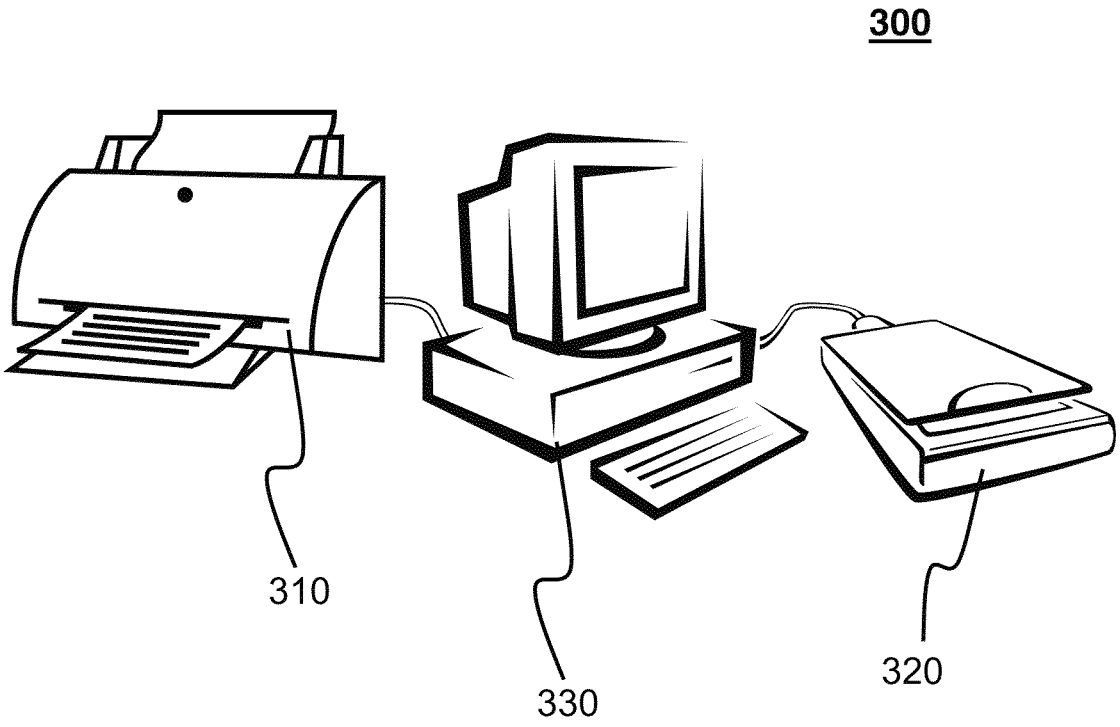
FIG. 3 shows schematically a system for identifying defective nozzles of a printhead of an inkjet printer.

FIG. 3 is a schematic diagram of a system 300 for identifying defective nozzles of a printhead of an inkjet printer 310. The system 300 includes the inkjet printer 310 being tested, an optically imaging device such as scanner 320, and a processing device such as general purpose computer 330. The inkjet printer 310 and scanner 320 are connected to, and controlled by, the computer 330. Although the optically imaging device is shown as the flatbed scanner 320, it will be appreciated that other types of optically imaging device may be employed. For example, the imaging device may be a portable handheld scanner. Alternatively, the imaging device may be integrated into the printer 310, preferably positioned in a media feed path downstream of an inkjet printhead (see, for example, the printhead and scanner arrangement described in US 2011/0025799, the contents of which are incorporated herein by reference).

Figure 4:
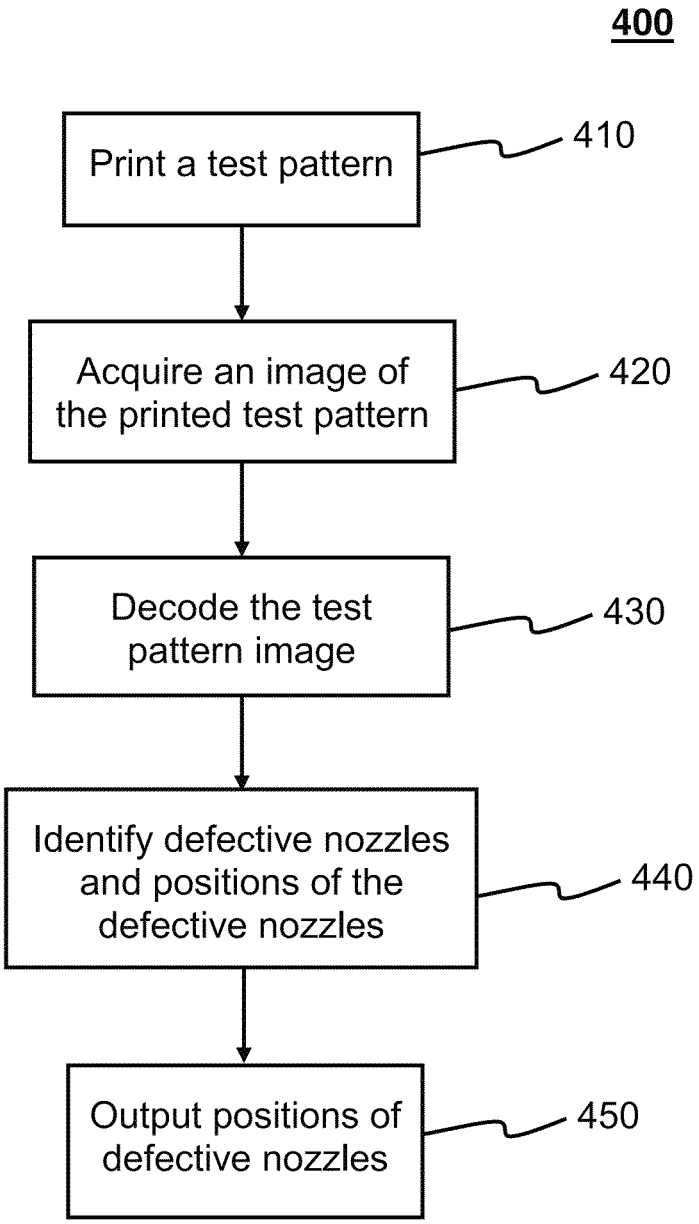
FIG. 4 shows a schematic flow diagram of a method according to the present invention of identifying defective nozzles of the printhead of the inkjet printer.

FIG. 4 shows a schematic flow diagram of a method 400 according to the present invention of identifying defective nozzles of the printhead of the inkjet printer 310 (FIG. 3). The processes of the method 400 are preferably implemented as software executable within the computer 330 (FIG. 3). The method 400 may alternatively be implemented in dedicated hardware including microprocessors and associated memories. For example, a customized optically imaging device may comprise a processor and embedded firmware for implementing the method of the present invention.

Method 400 starts in step 410 where computer 330 controls the inkjet printer 310 to print a test pattern. In the preferred implementation the nozzles corresponding to each ink plane ("colour plane") print a separate test pattern which is also processed separately to identify defective nozzles for that colour plane. As would be described in detail below, the test pattern is made up from juxtaposed coded line patterns, with each coded line pattern being printed by a respective nozzle of the printhead of the inkjet printer 310. The test pattern is coded such that individual nozzles which failed to print their respective coded test patterns correctly are identifiable. Accordingly, the test pattern encodes the identity, or position within the printhead, of the individual nozzles.

Method 400 then proceeds to step 420 where the computer 330 uses the scanner 320 to acquire an image of at least part of the test pattern. For simplicity that image is simply referred to as the test pattern image hereafter.

In step 430 the computer 340 decodes the test pattern image. The method 400 next proceeds to step 440 where the decoded test pattern is processed by the computer 330 to determine whether the part of the test pattern imaged by the scanner 320 contains line patterns printed by defective nozzles, and the positions of such defective nozzles. More particularly, defective nozzles are determined by identifying absent or incomplete coded line patterns in the decoded test pattern. It is inferred that the reason for a particular coded line pattern to be absent or incomplete is due to the nozzle which printed that coded line pattern being defective. Steps 430 and 440 are described in detail below.

The method 400 ends in step 450 where the identities or positions of defective nozzles within the printhead are output by the computer 330, for example by displaying a list of the identities or positions on a display screen of the computer 330.

The principles upon which the test pattern, and thus the coded line patterns, is based are next described, followed by a description of the preferred test pattern.

In the preferred implementation coded line patterns are detected using the inner product or (dot product) between the test pattern image and the codewords which form the basis of the coded line patterns forming the printed test pattern. In the preferred implementation the coded line patterns are orthogonal at zero phase offset to neighbouring coded line patterns.

Preferably each of the coded line patterns is also balanced, that is having equal amounts of printed pixels and non-printed pixels in the line pattern. The advantages of balanced coded line patterns include the simulation of conditions closer to real-life printing conditions, and better use of the scanner's dynamic range.

In view of the foregoing, in the preferred implementation the coded line patterns are based upon Hadamard matrices. A Hadamard matrix is a square matrix whose entries are either +1 or −1 and whose rows are mutually orthogonal. One method of constructing examples of Hadamard matrices, Sylvester's construction, is as follows:

$$H_1 = [1], \quad \text{Eq. (1)}$$

$$H_2 = \begin{bmatrix} 1 & 1 \\ 1 & -1 \end{bmatrix}, \quad \text{Eq. (2)}$$

and $$H_{2^k} = \begin{bmatrix} H_{2^{k-1}} & H_{2^{k-1}} \\ H_{2^{k-1}} & -H_{2^{k-1}} \end{bmatrix} - H_2 \otimes H_{2^{k-1}}, \quad \text{Eq. (3)}$$

for $2 \leq k \in N$, where $\otimes$ denotes the Kronecker product.

In the present context an advantageous property of the Hadamard matrix is that the dot product of any two distinct rows (or columns) is zero.

The following is an example of a Hadamard matrix where k=2:

$$H_4 = \begin{bmatrix} 1 & 1 & 1 & 1 \\ 1 & -1 & 1 & -1 \\ 1 & 1 & -1 & -1 \\ 1 & -1 & -1 & 1 \end{bmatrix} \quad \text{Eq. (4)}$$

and as can be seen the dot product between any two columns is always 0.

A further desirable property of Hadamard matrices results from the fact that the rows and columns, with the exception of row 0 and column 0, are balanced, that is the sum along any one row or column is 0. Therefore, a suitable coding matrix based upon the Hadamard matrix where k=2 (see Eq. (4)) provides 3 unique orthogonal codewords of the following coding matrix:

$$C_{2^k \times 2^{k-1}} = \begin{bmatrix} 1 & 1 & 1 \\ -1 & 1 & -1 \\ 1 & -1 & -1 \\ -1 & -1 & 1 \end{bmatrix} \quad \text{Eq. (5)}$$

Figure 5:
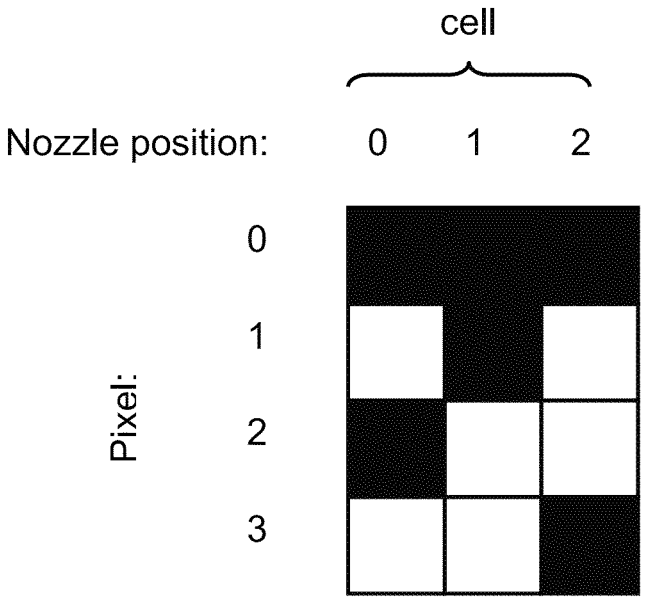
FIG. 5 illustrates 3 unique coded line patterns printed by a cell of nozzles.

Those codewords may be used to define 3 unique coded line patterns represented by the columns, where a 1 in the coding matrix represents a printed pixel, and a −1 in the coding matrix represents a non-printed (i.e. absent) pixel. Those 3 unique coded line patterns are printed by a grouping of 3 neighbouring nozzles, with the grouping being referred to as a "cell" of nozzles. FIG. 5 illustrates the 3 unique coded line patterns printed by the cell of nozzles.

However, even though coded line patterns purely based upon the Hadamard matrix would be ideal, because each coded line pattern printed by respective nozzles would be unique, balanced, and orthogonal to any other line pattern, such an arrangement is impractical when the number of nozzles is large. For example, an A4 printer having a printhead that is the width of the page being printed may have as many as 14036 nozzles per ink plane (or "colour plane").

Even when the nozzles printing respective colour planes are treated separately, coded line patterns of length 16384 would be needed to provide mutually orthogonal line patterns.

Accordingly, the coded line patterns of the present invention use a secondary coding scheme to uniquely code respective cells of a particular colour plane. A nozzle is then uniquely coded by its position within a cell and the cell position with the ink plane by first and second coding schemes, respectively. The second encoding scheme preferably has low cross-correlation properties and a unimodal auto-correlation property.

The secondary scheme used in the preferred implementation is a Maximal Length Sequences or an M-sequence. M-sequences are by definition the largest codes that can be generated by a given shift register or a delay element of a given length. The output for given clock cycle i may be mathematically represented by Eq. (6) below, where all addition and multiplication operations are modulo-2.

$$a_i = c_1 a_{i-1} + c_2 a_{i-2} + \ldots + c_n a_{i-n} = \sum_{k=1}^{n} c_k a_{i-k} \quad \text{Eq. (6)}$$

The following is an example of an M-sequence as produced by the primitive polynomial $x^3+x+1$ where n=3:

$$a_i = a_{i-2} + a_{i-3} = [1,0,1,1,1,0,0] \quad \text{Eq. (7)}$$

for $i \geq 0$ where the seed values for the registers $a_{-3}$, $a_{-2}$ and $a_{-1}$ are 1, 0, 0 respectively. The length of the sequence is $(2^n-1)$ bits. Notably, no combination of n consecutive bits is repeated throughout the sequence, that is to say the sequence is maximal. It is also noted that the M-sequence, irrespective of its length, is approximately balanced i.e. there is only one extra 1 with respect to the total number of 1's and 0's.

Another property of the M-sequence useful for the purposes of the present implementation is that the autocorrelation function of an M-sequence is a very close approximation to a Kronecker delta function. As the M-sequence length is increased the approximation of the Kronecker delta function improves.

Eq. (8) below shows a coding sequence based upon the simple M-sequence shown in Eq. (7).

$$A = [1,-1,1,1,1,-1,-1] \quad \text{Eq. (8)}$$

The encoder for uniquely encoding the position of each nozzle in the printhead is defined as follows:

$$E = A \otimes C \quad \text{Eq. (9)}$$

Substituting Eqs. (5) and (8) into Eq. (9) provides the test pattern illustrated in FIG. 6. As can be seen, the nozzles of cells corresponding to M-sequence values of 1 print coded line patterns correspond to the coded line patterns shown in FIG. 5, whereas the nozzles of cells corresponding to M-sequence values of −1 print coded line patterns correspond to the inverse of the coded line patterns shown in FIG. 5. The example test pattern shown in FIG. 6 uniquely encodes the position of 21 nozzles, with each of the 21 nozzles printing a coded line pattern of length 4 pixels.

In the present example where a 3 bit M-sequence is used, by considering any part of the test pattern containing the coded line patterns printed by the nozzles of at least 3 consecutive and complete cells, the nozzle that printed any particular coded line pattern within that part of the test pattern is uniquely identifiable by first identifying the cell the nozzle belongs to, and then identifying the position of the nozzle within that cell.

Having described the principles upon which the test pattern, and thus the coded line patterns, is based, the preferred test pattern is next described. In order to encode N nozzles using the encoder described above, and for a selected k number of codes per cell and hence k nozzles per grouping, it can be shown that the minimum number of bits required by the M-sequence is given by:

$$b = \left\lceil \log_2 \left\lceil \frac{N}{2^k - 1} \right\rceil \right\rceil \quad \text{Eq. (10)}$$

Therefore, for a printhead with N=14036 addressable nozzles and selecting k=5, i.e. 31 codes per cell and hence 31 nozzles per grouping, the minimum number of bits required by the M-sequence is:

$$b = \left\lceil \log_2 \left\lceil \frac{14036}{2^5 - 1} \right\rceil \right\rceil = 9bits \quad \text{Eq. (11)}$$

In the preferred implementation k=6 is selected, providing a coded line pattern of length 64 pixels. However, even though 63 usable codes per cell are provided by that selection, only a selection of those usable codes is used. As already explained, the first column of the Hadamard matrix is discarded, the reason being that the first column does not provide a balanced code. Another reason for the first column of the Hadamard matrix being unsuitable in the present encoder is that, when that column is inverted according to Eq. (9), a coded line pattern containing only non-printed pixels is provided.

In one implementation, in addition to discarding the first column (i.e. column 0) of the Hadamard matrix, the first column from every grouping of four columns of the Hadamard matrix is discarded, i.e. columns 1, 5, 9 etc. since those columns represent coded line patterns having long runs between transitions. In the preferred implementation, in addition to discarding the first column of the Hadamard matrix, only every second column of the Hadamard matrix is used, i.e. columns 2, 4, 6, etc. Accordingly, each cell has 32 codes. For N=14036 addressable nozzles, the minimum number of bits required by the M-sequence is 11. To assist in the processing of the test pattern image, a header may also be printed prior to printing the test pattern. In one implementation the header is simply a line formed by all nozzles (of the present colour plane) printing 3 successive pixels and separated from the test pattern by a predetermined number of non-printed pixels. It is noted that none of the coded line patterns contain a sequence of 3 successive pixels.

Having described the composition of the test pattern, and thus the coded line patterns, printed in step 410 of method 400 (FIG. 4), step 430 where the computer 340 (FIG. 3) decodes the test pattern image is next described. With regards to the test pattern image, given the preferred implementation of where an M-sequence of 9 bits is used, that test pattern image needs to include at least the coded line patterns and header printed by the nozzles of 9 cells (i.e. 9×32 nozzles). In the preferred implementation the test pattern image includes at least the coded line patterns and header printed by the nozzles of 16 cells, with 16 being chosen for added redundancy.

Figure 7:
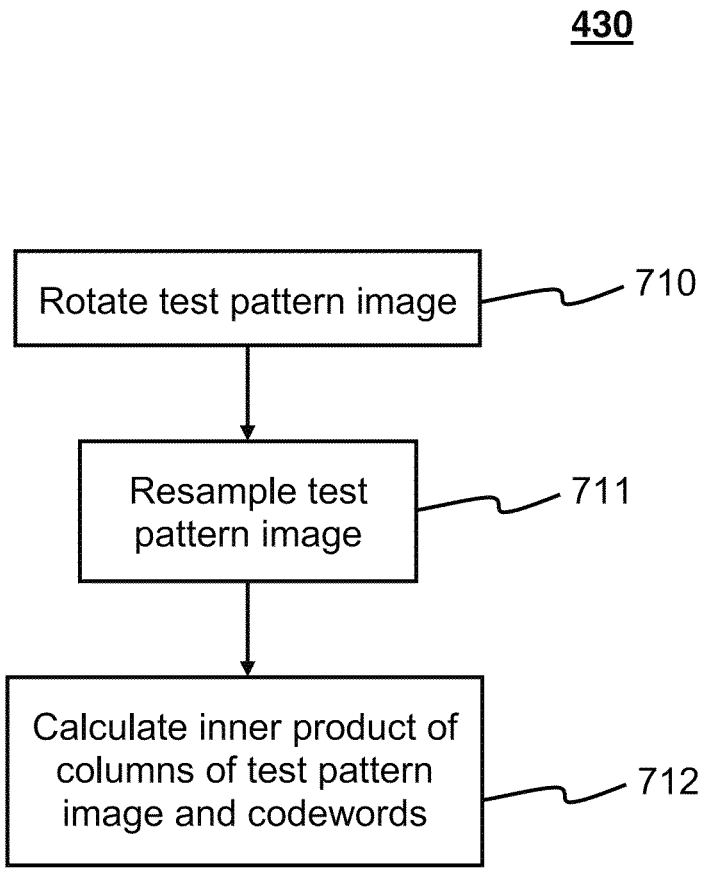
FIG. 7 shows a schematic flow diagram of the sub-steps of decoding an imaged test pattern.

FIG. 7 shows a schematic flow diagram of the sub-steps of step 430 (FIG. 4) where the imaged test pattern is decoded. Step 430 starts in sub-step 710 where the test pattern image is rotated with the aid of the header line. The test pattern image is then resampled in sub-step 711 as appropriate to identify the respective coded line patterns appearing in the image.

Step 430 then continues to sub-step 712 where the dot or inner product of each column of the test pattern image and each respective codeword is calculated. The respective codewords are the columns of the coding matrix C. Sub-step 712 produces a 'trace' representative of the detection of each respective codeword over the width of the test pattern image. A trace matrix T may be formulated as follows:

$$T_{2^k-1\times n} = \quad \text{Eq. (12)}$$

$$[C^T D]_{i,j} = C_{0,i}D_{0,j} + C_{1,i}D_{1,j} + \ldots + C_{m,i}D_{m,j} = \sum_{r=0}^{m-1} C_{ri}D_{rj}$$

wherein C is the coding matrix, D is the test pattern image in matrix form, m is the number of rows in the coding matrix C, i.e. the length of the codewords and coded line patterns, which is also the number of rows in the imaged test pattern D, and n is the width of the test pattern image D.

Figure 6:
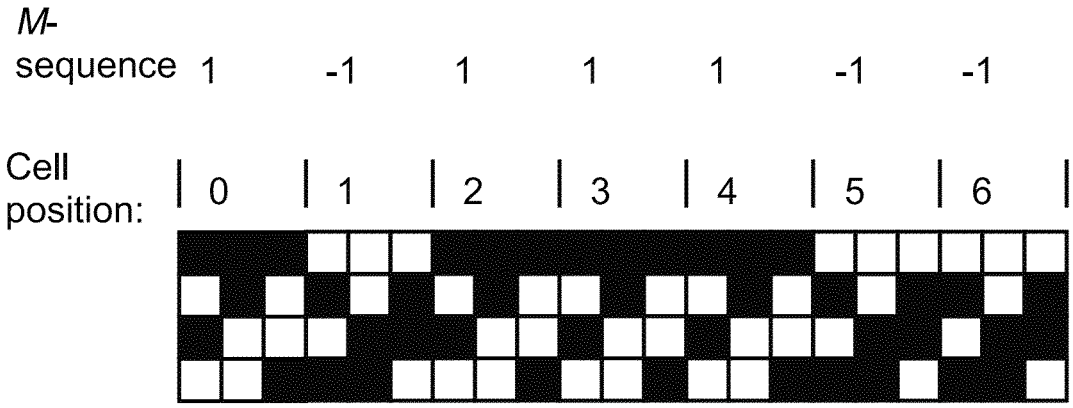
FIG. 6 illustrates an example test pattern for uniquely encoding the positions of 21 nozzles.
Figure 8A:
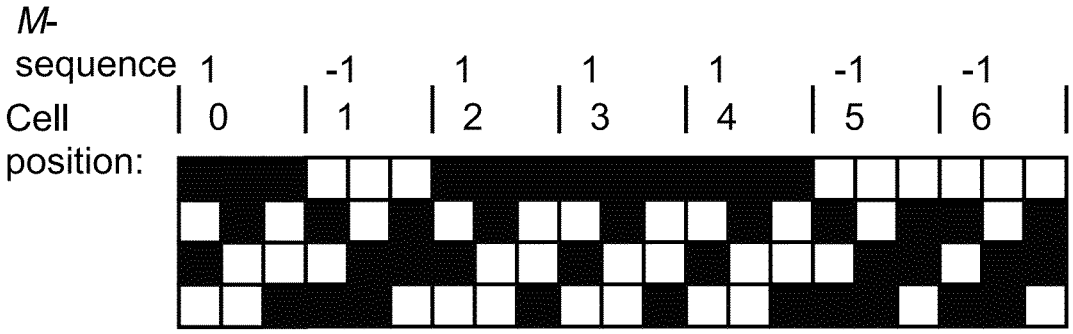
FIGS. 8A to 8E illustrate the decoding of an example imaged test pattern.
Figure 8B:
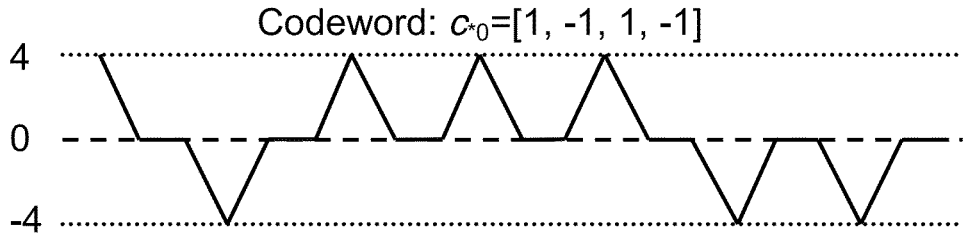
Figure 8C:
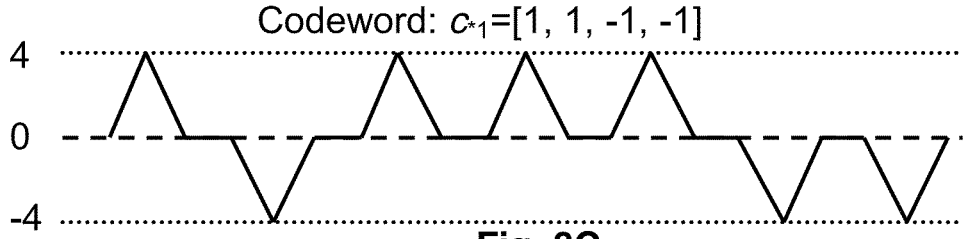
Figure 8D:
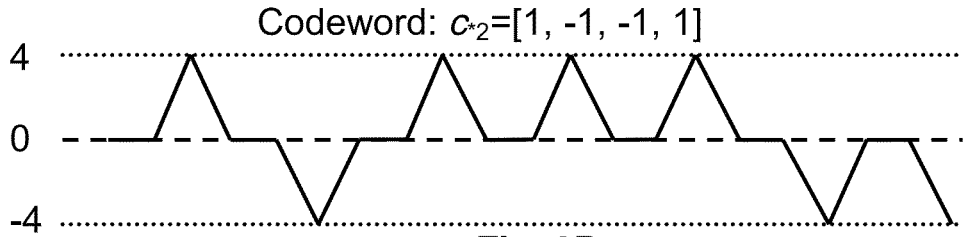

FIG. 8A illustrates an example imaged test pattern D, which is the test pattern illustrated in FIG. 6. FIGS. 8B to 8D visually depict the rows of trace matrix T resulting when Eq. (5) is used as the coding matrix C to decode the imaged test pattern D illustrated in FIG. 8A. Considering a unique codeword is assigned to each nozzle within a cell and this encoding is repeated in each cell, under ideal conditions i.e. zero bits errors, an instance of each codeword (or column of coding matrix C) is found within each cell. The rows of trace matrix T have a value of m corresponding to positions in the imaged test pattern D where the corresponding codeword appears, a value of −m corresponding to positions in the imaged test pattern D where the inverse of the corresponding codeword appears, and a value of 0 corresponding to positions in the imaged test pattern D where the corresponding codeword does not appear.

Figure 8E:
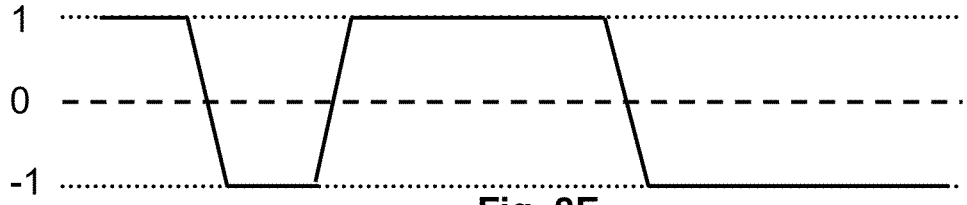

FIG. 8E shows a trace of the normalized sum of the rows of the trace matrix T. Thresholding is applied to positive values to have a value of 1 and negative values to have a value of −1. The values of that trace correspond with the values of the M-sequence used, i.e. the coding sequence shown in Eq. (9).

Having decoded the test pattern image to produce trace matrix T in step 430, step 440 where the trace matrix T is processed to determine whether the test pattern image contains line patterns printed by defective nozzles, and the positions of such defective nozzles, is next described. Referring again to FIGS. 8B to 8D, in the situation where all the nozzles are functional and no errors are introduced in the scanning process, each of the rows of trace matrix T should have either a value of m or −m spaced j columns apart, with j being the number of nozzles in each cell. A value less than mod(m) at positions where either a value of m or −m is expected indicates a defective nozzle. The positions of any defective nozzles are calculated by determining the cell position within the colour place of each defective nozzle, followed by the respective nozzle positions of the defective nozzles within those cells.

Figure 9A:
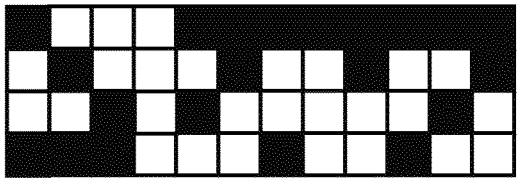
FIGS. 9A to 9E illustrate the decoding of an image of part of an example test pattern, and identifying the positions of defective nozzles.

FIG. 9A illustrates an example imaged part of a printed test pattern D. The test pattern, only a part of which being imaged, is produced using the coding matrix C of Eq. (5). The imaged test pattern includes only 12 coded line patterns printed by 12 of the 21 nozzles. The operations of steps 430 and 440 on that imaged test pattern are illustrated by way of example.

Figure 9B:
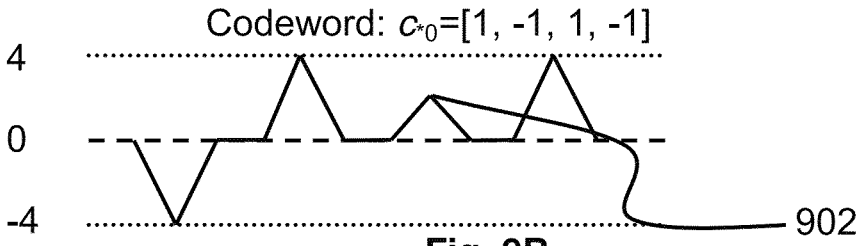
Figure 9C:
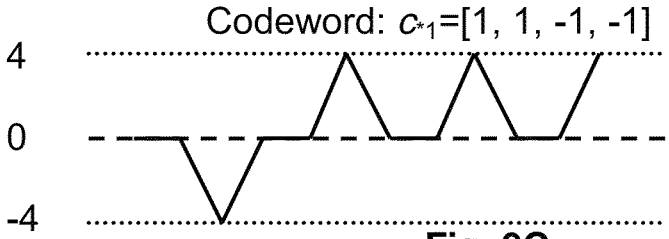
Figure 9D:
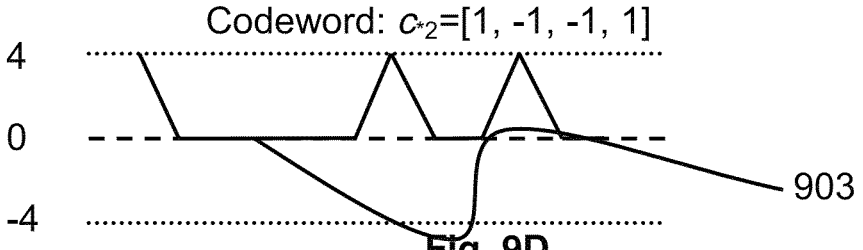
Figure 9E:
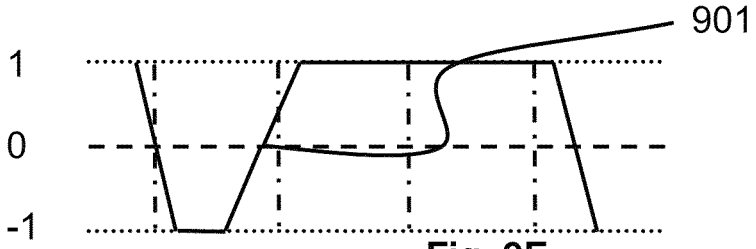

FIGS. 9B to 9D depict the rows of trace matrix T resulting when the coding matrix C of Eq. (5) is used in step 430 to decode the imaged test pattern D illustrated in FIG. 9A. FIG. 9E shows a trace of the normalized sum of the rows of the trace matrix T Step 440 starts by processing the trace of the normalized sum of the rows of the trace matrix T (FIG. 9E). It is known that the values of the trace of the normalized sum of the rows of the trace matrix T should be either 1 or −1. It is noted at 901 that the value of the trace is not the expected value, but it is unknown what that value should be.

Knowledge of the cell size being 3, and the order of the codewords in the respective cells allow for the transitions between cells to be determined, as is indicated in FIG. 9E. This indicates that the imaged test pattern includes 3 complete cells, and from the trace illustrated in FIG. 9E, the portion of the M=sequence represented by that trace is:

$$[-1,1,1] \quad \text{Eq. (13)}$$

Referring to Eq. (8), the portion of the M-sequence shown in Eq. (13) corresponds to an offset of 1. Accordingly, it is determined that cells 1, 2 and 3 are fully represented in FIG. 9A, remembering the cells are numbered 0, 1, 2, . . . , 6.

Step 440 continues by processing each of the rows of trace matrix T (FIGS. 9B to 9D). Knowing that each of the rows of trace matrix T should have either a value of 4 or −4 spaced 3 columns apart indicates 2 defective nozzles at 902 and 903 where the values are 2 and 0 respectively instead of the expected value of 4 or −4.

The position of the defective nozzle corresponding to error 902 is calculated to be in cell 3, and nozzle position 0 within that cell, which is nozzle position (3*3)+0=9, remembering that the nozzles are numbered 0, 1, 2, . . . , 21. The position of the defective nozzle corresponding to error 903 is calculated to be in cell 1, and nozzle position 2 within that cell, which is nozzle position (1*3)+2=5. Referring to the imaged test pattern illustrated in FIG. 9A, it can be seen that the nozzle causing error 903 did not print any pixels, whereas the nozzle causing error 902 did not print a valid coded line pattern.

In conclusion, even though the image of the printed test pattern did not include the entire printed test pattern, the defective nozzles were identified using the method 400 of the present invention as being the nozzles at positions 5 and 9 of the example printhead having 21 addressable nozzles.

The foregoing describes only some embodiments of the present invention, and modifications of detail may be made thereto without departing from the scope of the invention, the embodiments being illustrative and not restrictive.

The invention claimed is:

1. A method of identifying defective nozzles of a printhead having one or more ink planes, each ink plane comprising at least one row of nozzles supplied with a same ink, the nozzles in one ink plane being nominally divided into a plurality of neighbouring cells, each cell comprising a set of neighbouring nozzles, said method comprising the steps of:

instructing each nozzle in one ink plane of the printhead to print a respective coded line pattern, each coded line pattern being represented by a column of printed pixels and absent pixels, the coded line patterns being defined by first and second coding schemes, the first coding scheme encoding a position of each nozzle within its respective cell and the second coding scheme encoding a position of each cell within its respective ink plane, firing each nozzle of the ink plane to print a test pattern comprising a plurality of neighbouring coded line patterns;

imaging an area of the test pattern to obtain an imaged test pattern;

decoding the imaged test pattern using the first and second coding schemes; and identifying the defective nozzles using the decoded imaged test pattern.

2. The method of claim 1, wherein the first coding scheme employs first bit values of 1 and 0, a first bit value of 1 being represented by printed pixels in first cells and absent pixels in inverse second cells, and a first bit value of 0 being represented by absent pixels in the first cells and printed pixels in the inverse second cells.

3. The method of claim 1, wherein second bit values in the second coding scheme are represented by the first cells and the inverse second cells.

4. The method of claim 1, wherein a cell of nozzles is defined as k neighbouring nozzles, wherein k is an integer from 2 to 100, said cell of nozzles printing a corresponding cell of k neighbouring coded line patterns.

5. The method of claim 1, wherein the nozzles in one cell are physically juxtaposed and/or logically juxtaposed.

6. The method of claim 1, wherein the coded line patterns printed by respective nozzles contained within any one cell define mutually orthogonal codes at zero offset.

7. The method of claim 1, wherein the first coding scheme is based on a Hadamard matrix.

8. The method of claim 7, wherein a first column of the Hadamard matrix is unused in the first coding scheme.

9. The method of claim 1, wherein the second coding scheme is based on an M-sequence.

10. The method of claim 9, wherein the M-sequence is of length $(2^n-1)$, wherein n is an integer of 1 or more, and the imaged area of the test pattern contains complete coded line patterns for at least n complete cells.

11. The method of claim 10, wherein the imaged area of the test pattern is less than a complete extent of the test pattern.

12. The method of claim 1, wherein each line pattern is balanced having an equal number of printed pixels and absent pixels.

13. The method of claim 1, wherein the line patterns are based on codewords, and the imaged test pattern is decoded by calculating the inner product between the respective codewords and respective line patterns.

14. The method of claim 13, wherein defective nozzles are identified by determining whether the decoded imaged test pattern contains invalid values.

15. A print medium having a test pattern printed thereon from at least one ink plane of a printhead, each ink plane comprising at least one row of nozzles supplied with a same ink, the nozzles in one ink plane being nominally divided into a plurality of neighbouring cells, each cell comprising a set of neighbouring nozzles, wherein the test pattern comprises a plurality of neighbouring coded line patterns printed from respective neighbouring nozzles of the ink plane, each coded line pattern being represented by a column of printed pixels and absent pixels, the coded line patterns being defined by first and second coding schemes, the first coding scheme encoding a position of each nozzle within its respective cell and the second coding scheme encoding a position of each cell within its respective ink plane.

16. The print medium of claim 15, wherein the first coding scheme employs first bit values of 1 or 0, a first bit value of 1 being represented by printed pixels in first cells and absent pixels in inverse second cells, and a first bit value of 0 being represented by absent pixels in the first cells and printed pixels in the inverse second cells.

17. The print medium of claim 16, wherein second bit values in the second coding scheme are represented by the first cells and the inverse second cells.

18. The print medium of claim 15, wherein the test pattern comprises a two-dimensional array of contiguous bi-level pixels.

19. An apparatus for identifying defective nozzles of a printhead having one or more ink planes, each ink plane comprising at least one row of nozzles supplied with a same ink, the nozzles in one ink plane being nominally divided into a plurality of neighbouring cells, each cell comprising a set of neighbouring nozzles, said apparatus comprising:

a sensor for optically imaging an area of a test pattern printed on a print medium, the test pattern comprising a plurality of neighbouring coded line patterns printed from respective neighbouring nozzles of an ink plane of the printhead, each coded line pattern being represented by a column of printed pixels and absent pixels, the coded line patterns being defined by first and second coding schemes, the first coding scheme encoding a position of each nozzle within its respective cell and the second coding scheme encoding a position of each cell within its respective ink plane; and a processor configured for:

decoding the imaged test pattern using the first and second coding schemes; and identifying the defective nozzles using the decoded imaged test pattern.

20. The apparatus of claim 19, wherein the line patterns are based on codewords, and the processor is configured to:

decode the imaged test pattern by calculating the inner product between the respective codewords and respective line patterns; and identify defective nozzles by determining whether the decoded imaged test pattern contains invalid values.

* * * * *